United States Patent [19]

Smith et al.

[11] 4,413,642

[45] Nov. 8, 1983

[54] BLOWOUT PREVENTER CONTROL SYSTEM

[75] Inventors: Gary D. Smith; Richard D. Relyea, both of Spring, Tex.

[73] Assignee: Ross Hill Controls Corporation, Houston, Tex.

[21] Appl. No.: 843,010

[22] Filed: Oct. 17, 1977

[51] Int. Cl.[3] ..... F16K 31/12

[52] U.S. Cl. ..... 137/14; 137/102; 137/116.3; 251/1 R

[58] Field of Search ..... 251/1; 137/102, 599, 137/505.41, 505.42, 116.3, 116.5, 14; 60/413

[56] References Cited

U.S. PATENT DOCUMENTS

| | | | |
|---|---|---|---|
| 1,887,578 | 11/1932 | Bush | 137/116.3 |
| 1,956,009 | 4/1934 | Diescher | 137/599 X |
| 2,047,101 | 7/1936 | Grove | 137/505.37 |
| 2,663,121 | 12/1953 | Ramsey | 137/116.3 |
| 2,971,537 | 2/1961 | Kowalski et al. | 137/636.1 |
| 3,044,481 | 7/1962 | Regan | 251/1 X |
| 3,102,549 | 9/1963 | Worden et al. | 137/116.5 X |
| 3,485,259 | 12/1969 | Ulbing | 137/116.3 |
| 3,519,011 | 7/1970 | Pennanen | 137/102 |
| 3,606,904 | 9/1971 | Taylor | 137/102 |
| 4,085,587 | 4/1978 | Garlinghouse | 60/413 X |

FOREIGN PATENT DOCUMENTS

| | | | |
|---|---|---|---|
| 684872 | 12/1939 | Fed. Rep. of Germany | 137/505.41 |

*Primary Examiner*—Martin P. Schwadron

*Attorney, Agent, or Firm*—Gerald G. Crutsinger; John F. Booth; Monty L. Ross

[57] ABSTRACT

A method and apparatus to control delivery of pressurized hydraulic fluid at a controlled pressure to open and close blowout preventers. A source of pressurized hydraulic fluid is connected through a pair of supply lines and through a control shifter valve for charging a closed system to a set-point pressure. A velocity fuse in each supply line diverts flow to one line if the other line breaks. Fluid from the source of pressurized hydraulic fluid is also delivered through a regulator valve to a regulated pressure line which is connected to one or more control valves. Each of the control valves is adapted to direct pressurized fluid selectively to either end of a blowout preventer actuator chamber. The regulator valve is adapted to block flow of pressurized fluid to the regulated pressure line when pressure in the regulated pressure line is equal to the set point pressure, to deliver pressurized fluid to the regulated pressure line when the pressure therein is less than the set point pressure, and to remove pressurized fluid from the regulated pressure line when pressure therein exceeds the set point pressure.

2 Claims, 22 Drawing Figures

BLOWOUT PREVENTER CONTROL SYSTEM

BACKGROUND OF THE INVENTION

Proper use of blowout preventers during well drilling and servicing operations is necessary to conserve oil and gas, prevent pollution of the environment, minimize danger of explosion of combustile fuel, control downhole pressure, and minimize waste of mud and other expensive materials circulated through the well.

Hydraulically actuated blowout preventers are of two basic types well known to persons skilled in the art, namely annular preventers and ram preventers. Each type of blowout preventer requires delivery of pressurized hydraulic fluid into and out of opening and closing chambers to control force urging seal elements into sealing relation with drill pipe, tubing or a wireline extending through a casing or to move seal elements into sealing relation with each other to close off an open hole.

Control systems are sometimes required to deliver hydraulic fluid at a pressure of 1,500 psi to opening and closing chambers of annular preventers and to hold the closing pressure on the preventer in case of an emergency.

Closing pressure of hydraulic fluid required for closing ram preventers is generally less than pressure required for closing annular preventers. Closing pressure for ram preventers is generally about 750 psi. However, closing pressure is dictated by the design criteria of the manufacturer.

When stripping drill pipe or tubing into or out of a well, pressure less than that required for closing a preventer is generally employed to permit movement of the pipe without causing excessive wear on the seal elements in the preventer.

Manually actuated control valves have been installed heretofore in a main control panel a substantial distance from the rig floor, for example, at the far end of the pipe rack, from which hydraulic fluid was controlled for actuation of blowout preventers. Remote closing units generally have been mounted on the floor of the drilling rig near the drillers position, for example, by the exit the driller would use when leaving the rig floor. Remote closing units, located remotely from the main control panel, generally have comprised a switch for actuating a solenoid valve through which pressurized fluid was delivered to hydraulic actuating cylinder connected to the control valve at the main control panel. Other remote closing units have consisted of valves which control the flow of compressed air to an actuating cylinder associated with the control valve at the main control panel.

When the driller on the drilling floor of a typical drilling rig actuated an air valve on the remote control panel, air supplied to the panel by rig air would flow through an air hose bundle and through the air circuitry to an air cylinder. The air cylinder was attached to the manual lever on a four-way hydraulic control valve. The air cylinder pushed the manual lever and opened or closed the four-way hydraulic control valve. Fluid flowing from the four-way hydraulic control valve through the hydraulic circuitry passed through control lines some distance, usually 100 feet or more, to blowout preventers which were usually a hydraulic cylinder arrangement. When the fluid was applied through the control lines, the preventers would close around whatever was in the hole, usually drill pipe.

Each four-way hydraulic control valve required two control lines, one connected to each end of the hydraulic cylinder which actuated a blowout preventer. On modern systems, this requires piping to run from the power unit to every function located some distance away. It also requires that all remote actuation, such as on the driller's panel or other remote units, run through air hose bundles back to the power unit where the four-way hydraulic control valves are located.

Thus, blowout preventer control systems heretofore devised required long runs of pipe between power units and blowout preventers. The driller could not manually actuate the four-way hydraulic control valves, and therefore, was required to depend upon the availability of air or electrical actuators to control blowout preventers from the rig floor. Further, in some installations, blowout preventer control systems have not been adequately protected from heavy equipment used at and around the well site.

Heretofore, the blowout preventer stack has been higher in vertical distance from the ground than have been the four-way hydraulic control valves located at the main control panel. Thus, fluid would flow back to the main control valves. Each time a function was actuated, the response time was increased by having to refill empty lines.

Blowout preventer control systems, heretofore devised, have not been easily adaptable for use in climates of extremely low temperature.

SUMMARY OF INVENTION

We have devised an improved blowout preventer control system wherein a source of pressurized hydraulic fluid, located remotely from a drilling rig floor, supplies pressurized fluid to a main control panel located on the drilling floor of the drilling rig. Four-way control valves are located in the main control panel and are secured directly to a valve block to which control lines are connected for deliverying pressurized hydraulic fluid to blowout preventers.

At least two pressure fluid supply lines are routed along separate paths from the source of pressurized fluid to the valve block in the main control panel to minimize the likelihood that the lines will be damaged. Velocity fuses are installed in the supply lines to divert flow to the other line in the event one line becomes ruptured.

A regulator valve is mounted on the control block along with a control shifter valve for establishing a set point pressure which will be maintained in a line between the regulator valve and each of the four-way hydraulic control valves.

One or more regulator valves and associated control shifter valves may be mounted in the main control panel which is positioned adjacent the driller's station so that regulated pressure can be adjusted immediately by the driller without moving from his station.

The four-way control valves are adapted for manual operation by the driller or for remote operation pneumatically or electrically.

The valve block and associated control valves, regulator valves, and control shifter valves are positioned in a main blowout preventer control panel or cabinet in a weather controlled atmosphere to prevent freezing and to provide protection from heavy equipment used at or near the well site.

A nitrogen back-up system is provided so that liquid can be drained from the blowout preventer control system and the system operated on pressurized nitrogen gas in extremely cold areas.

A primary object of the invention is to provide a control system for blowout preventers wherein blowout preventers are manually controlled from the driller's station on the rig floor.

Another object of the invention is to provide a system to control blowout preventers wherein control valves and regulator valves are mounted in a common valve block with hydraulic circuitry formed in the valve block to minimize the bulk of equipment and components required for providing necessary control functions and to provide a rugged durable construction.

Another object of the invention is to provide a control system for blowout preventers wherein long runs of multiple pipes between main control valves adjacent the power unit and the blowout preventer stack are eliminated.

Another object is to provide supply lines extending along different paths between a source of pressurized fluid and a blowout preventer control panel wherein velocity fuses are employed in the supply lines to divert flow to an undamaged line if one of the supply lines ruptures.

Another object of the invention is to provide a system for controlling blowout preventers wherein main control valves are positioned at an elevation above the elevation of the blowout preventers such that fluid in control lines between the main control valves and blowout preventers will flow toward opening and closing chambers in the blowout preventers, thus maintaining the control lines filled with hydraulic fluid.

A further object of the invention is to provide a system to control blowout preventers wherein the driller is provided with a mechanical selector for designating the appropriate annular preventer, pipe ram preventer, or blind ram preventer to be actuated at any instant during a drilling operation if an emergency occurs.

A still further object of the invention is to provide a control system for blowout preventers having a plurality of pressure regulators associated with different blowout preventers to provide different closing pressures to the different blowout preventers wherein the regulated pressures applied to each blowout preventer can be changed immediately by the driller from the driller's station.

A still further object of the invention is to provide a system for controlling blowout preventers wherein control valves and regulator valves are visible and within reach of the driller from the driller's station.

Other and further objects of the invention will become apparent upon referring to the detailed description hereinafter following and to the drawings annexed hereto.

DESCRIPTION OF THE DRAWING

Drawings of a preferred embodiment of the invention are annexed hereto, so that the invention may be better and more fully understood, in which.

Figure 1:
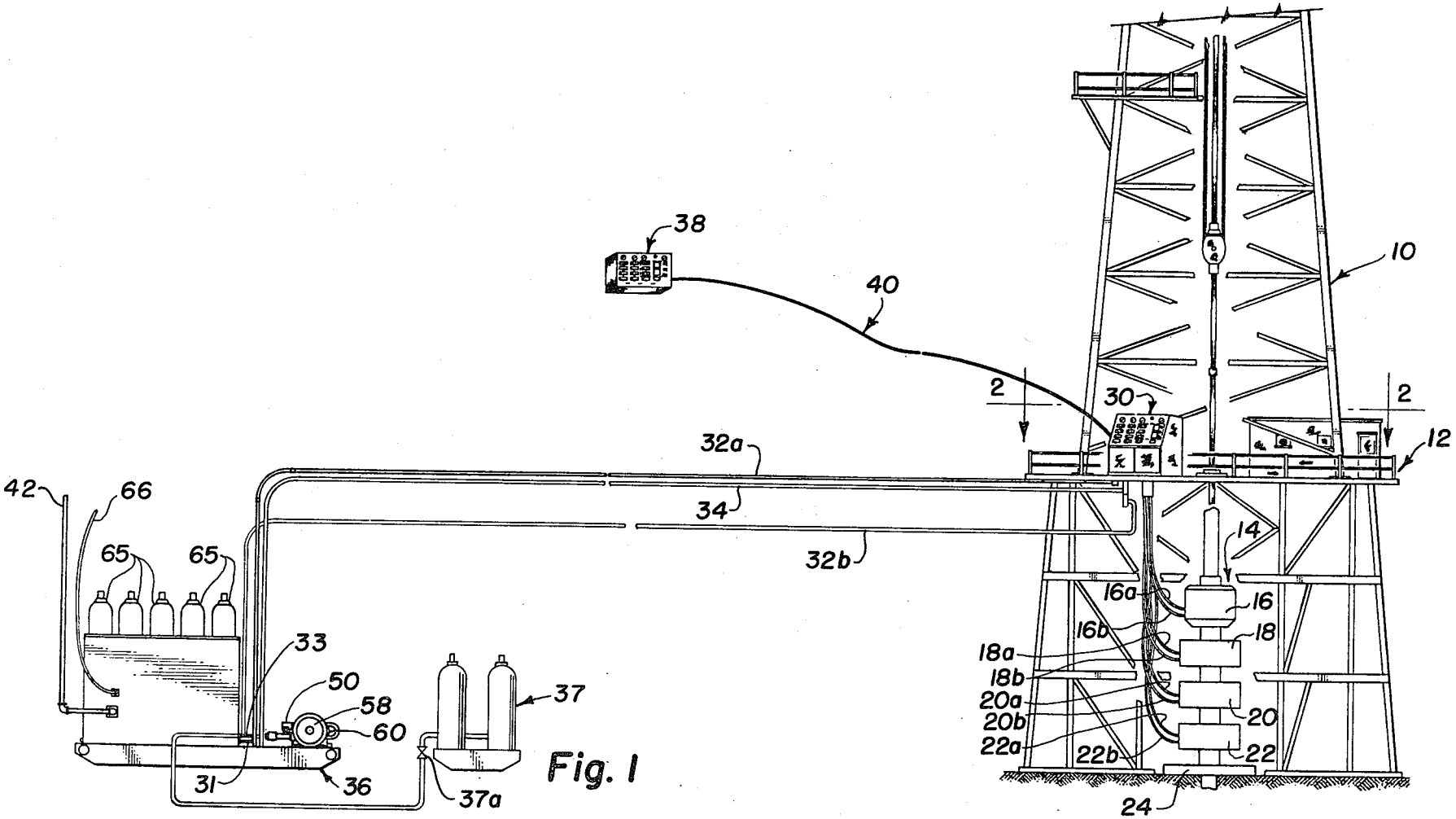
FIG. 1 is a diagrammatic view illustrating the relative positions of the components of blowout preventer control system.

Numeral references are employed to designate parts in the drawing.

DESCRIPTION OF A PREFERRED EMBODIMENT

Referring to FIG. 1 of the drawing, numeral 10 generally designates a drilling rig having an elevated platform or drilling floor 12 above a blowout preventer stack 14.

The blowout preventer stack includes an annular preventer 16, two sets of pipe ram preventers 18 and 20 and one set of blind ram preventers 22.

Blowout preventers 16, 18, 20 and 22 are of conventional design and are well known to persons skilled in the art.

The ram preventers should be spaced to permit placement of a drill pipe tool joint between rams for stripping operations.

The casing and tubing head 24 is diagrammatically illustrated and is well known to persons skilled in the drilling art.

A main blowout preventer control panel 30 is positioned on the drilling floor 12 of the drilling rig 10, as will be hereinafter more fully explained.

Supply pressure lines **32*a* and 32*b* and return line 34 are connected between main blowout preventer control panel 30 and hydraulic power unit 36**, as will be hereinafter more fully explained.

A remote control blowout preventer control panel 38 is connected through conduit 40 to the main control panel 30.

Figure 2:
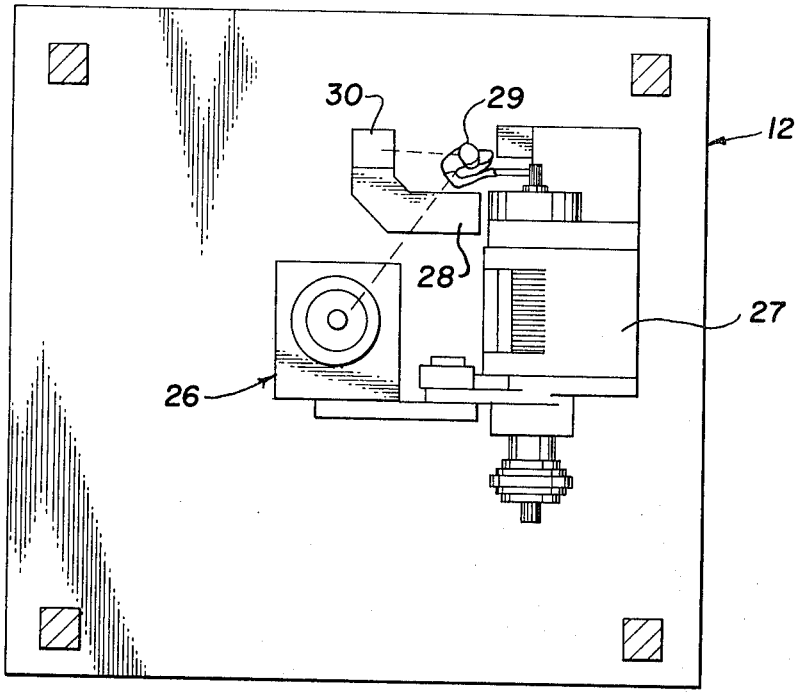
FIG. 2 is a cross-sectional view taken along line 2—2 of FIG. 1.

Referring to FIG. 2 of the drawing, it will be appreciated that main blowout preventer control panel 30 is positioned immediately adjacent drilling instrumentation panel 28 such that the main blowout preventer control panel 30 can be viewed by the driller 29 while performing his duties at the driller's station adjacent the drawworks 27 and the rotary table 26.

Figure 3:
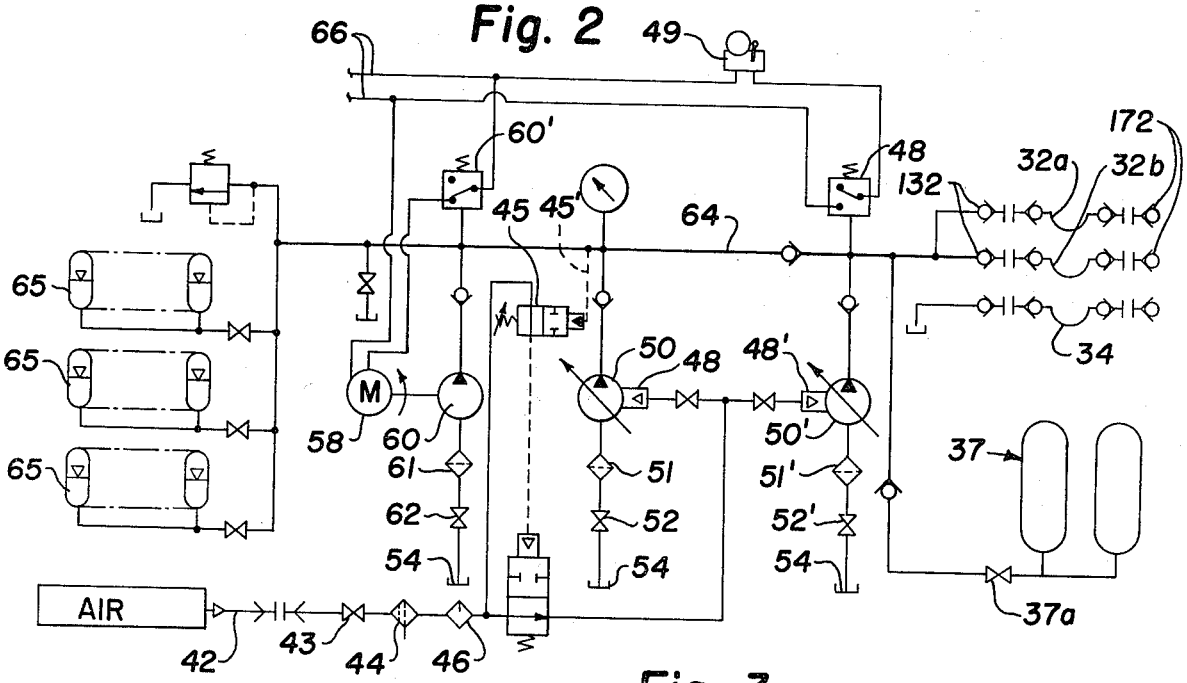
FIG. 3 is a schemmatic diagram of the source of pressurized hydraulic fluid.

A typical hydraulic power unit 36 is diagrammatically illustrated in FIG. 3 of the drawing. The primary function of the hydraulic power unit is to insure the supply of fluid at a controlled pressure to open and close blowout preventers 16–22.

Air is supplied through rig air line 42 from air compressors (not shown) at about 125 psi pressure.

Air line 42 directs pressurized air through conventional air line accessories including manual shutoff valve 43, lubricator 44, pressure regulator having adjustable relieving pressure 45 and filter-strainer 46 to drive a unidirectional pneumatic motor 48. Motor 48 is drivingly connected to unidirectional fixed displacement hydraulic pump 50. The suction side of pump 50 is connected through filter 51 and manual shutoff valve 52 to a vented reservoir 54.

Air line 42 also directs pressurized air to drive a second unidirectional pneumatic motor 48' drivingly connected to hydraulic pump 50'. The suction side of pump 50' is connected through filter 51' and manual shutoff valve 52' to vented reservoir 54.

An electric motor 58 is drivingly connected to a hydraulic pump 60, the suction side of which is connected through filter 61 and manual shutoff valve 62 to vented reservoir 54.

Pumps 50, 50' and 60 deliver a fluid, either oil or a water-based solution, through line 64 into accumulator bottles 65 at a pressure of approximately 3,000 psi. Accumulator bottles 65 are precharged to a pressure of approximately 1,000 psi with the inert gas nitrogen ($N_2$). A guided float or bladder is frequently used to separate the two modes, but neither are prerequisites for correct operation. The 1,000 psi precharge and the 3,000 psi final charge insure that the last drop of fluid leaving the accumulator bottle 65 leaves at a minimum pressure of 1,000 psi.

The pilot line 45' of air pressure regulator 45 is connected to line 64 to interrupt the flow of air to motors 48 and 48' when pressure in line 64 and accumulator bottles 65 rises to 3,000 psi.

Pressure switches 48 and 60' are connected to line 64. When accumulator bottles 65 are charged to 3,000 psi, pressure switch 60' will be actuated to turn off the motor 58. If pressure drops below a predetermined minimum, pressure switch 48 energizes a low pressure alarm 49.

When charged to a pressure of 3,000 psi the system is ready to operate. The system 36 contains a sufficient number of accumulator bottles 65 when totally charged to engage and disengage the complete blowout preventer stack 14 through one complete cycle and still have 25% reserve at 1,200 psi pressure.

The electric motor 58 and pump 60 provide a backup or redundant system parallel to the air driven hydraulic pumps 50 and 50'. Rig power line 66 at 220 or 440 volts is connected to electric motor 58 which drives pump 60.

In the event of an unplanned loss of pressure in accumulator bottles 65, pumps 50 and 50' must be capable of delivering sufficient fluid at 1,200 psi to close the entire blowout preventer stack 14 one time in two minutes or less.

Hydraulic power units similar to that diagrammatically illustrated in FIG. 3 of the drawing are commercially available and are well known to persons having ordinary skill in the art. Such systems are described in the 24th edition (1960-61) of "Composite Catalog", published by World Oil, at pages 2,858–2,864 and 4,960–4,963. However, hydraulic power units heretofore devised have been equipped with hydraulic control valves for delivering pressurized fluid from accumulator bottle 65 directly to blowout preventer stack 14, the control valves being actuated manually at the hydraulic power unit, or electrically, hydraulically or pneumatically from other locations remote from the hydraulic power unit 36.

Figure 10:
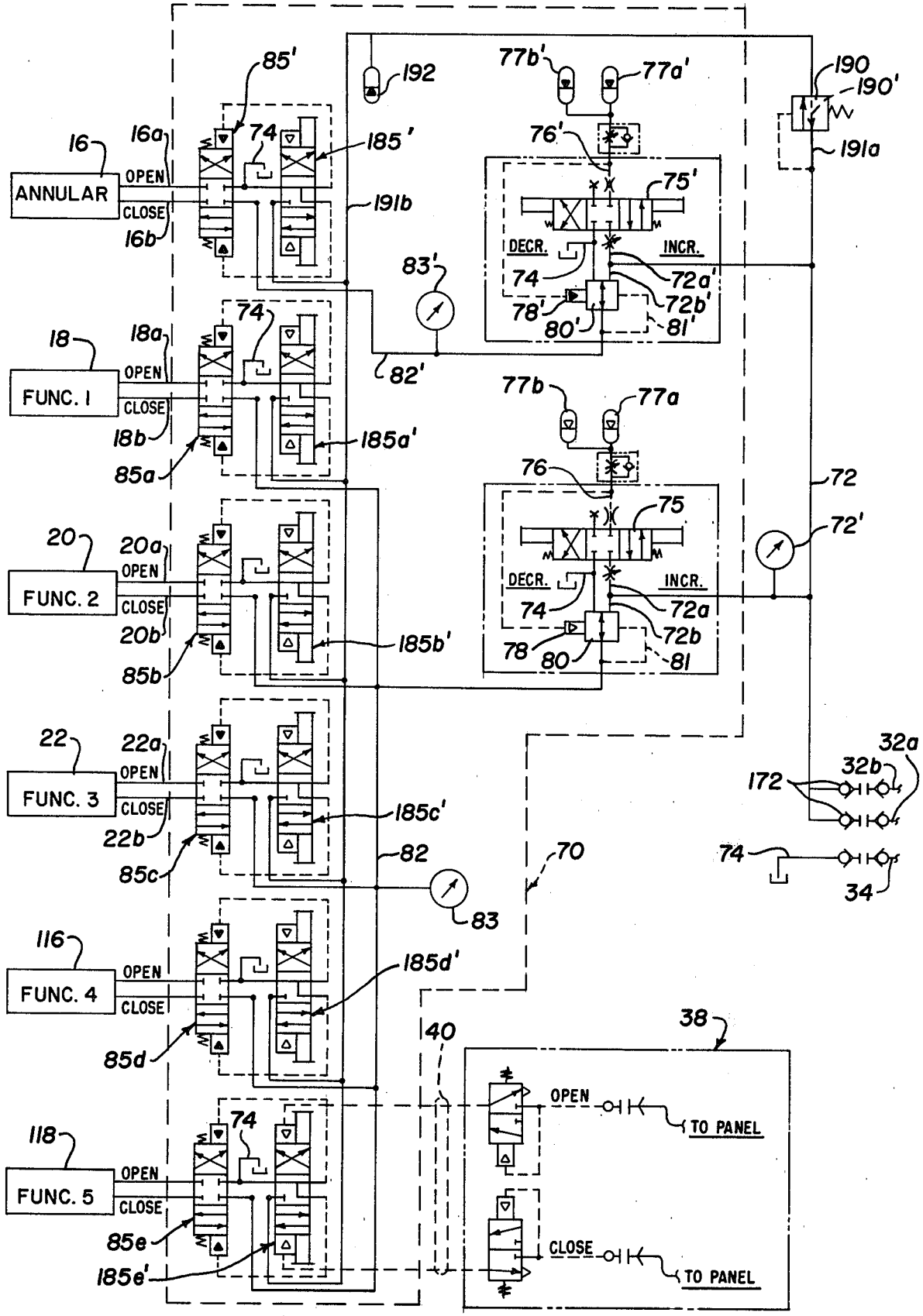
FIG. 10 is a schemmatic diagram of the main blowout preventer control hydraulic circuitry.
Figure 12:
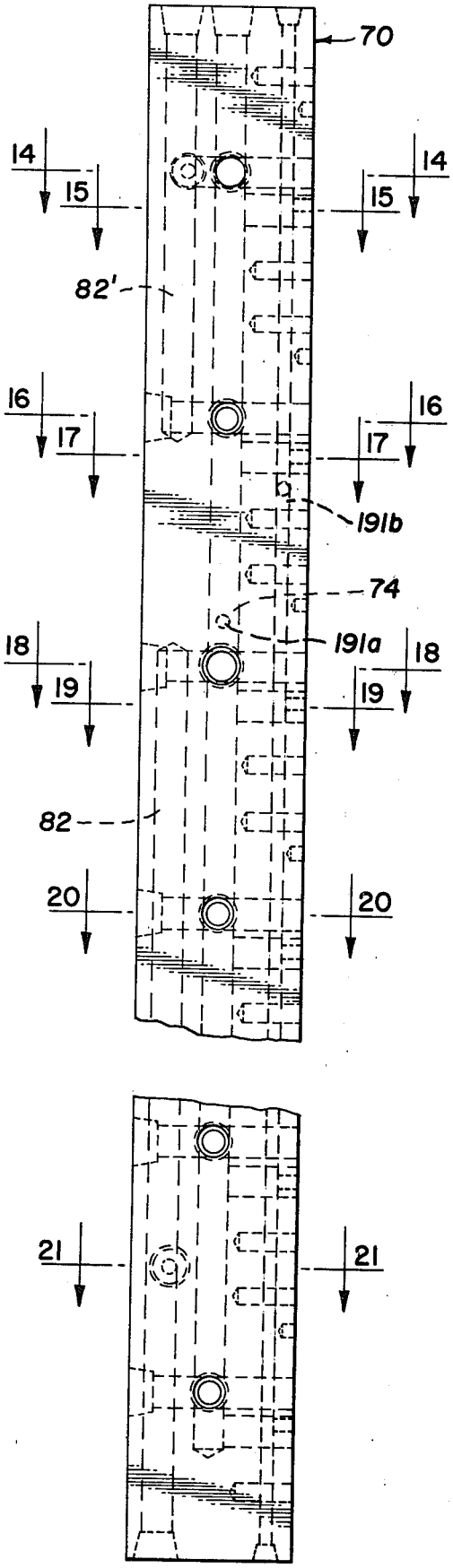
FIG. 12 is a side elevational view of a valve block.
Figure 11:
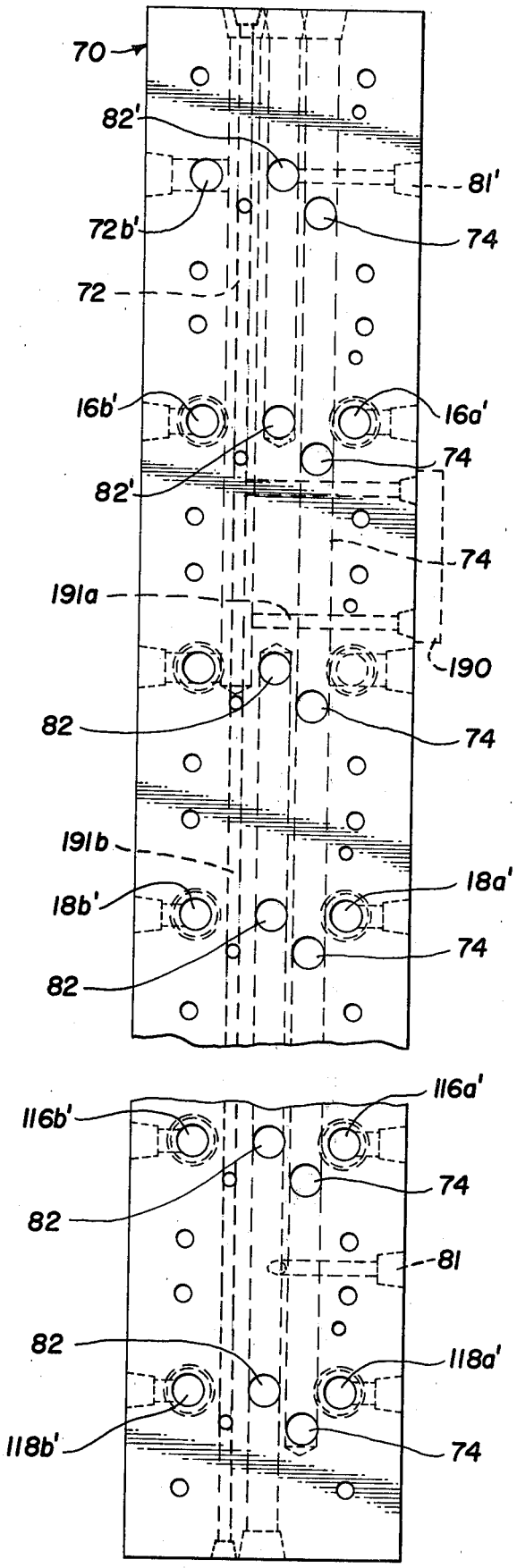
FIG. 11 is a front elevational view of the valve block.
Figure 13:
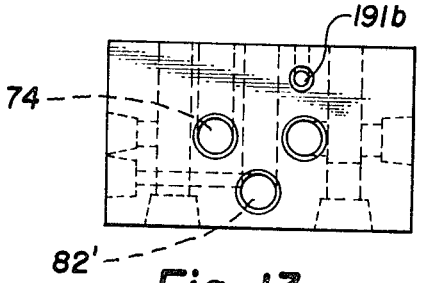
FIG. 13 is a top plan view of the valve block.
Figure 14:
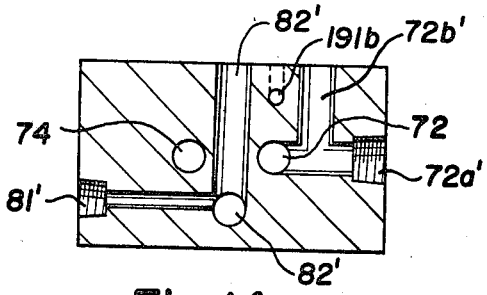
FIG. 14 is a cross-sectional view taken along line 14—14 of FIG. 12.
Figure 15:
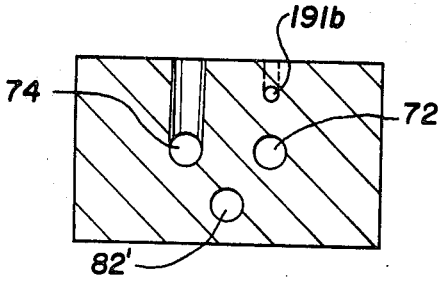
FIG. 15 is a cross-sectional view taken along line 15—15 of FIG. 12.
Figure 16:
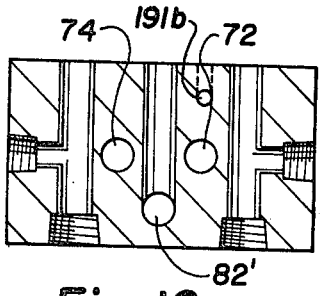
FIG. 16 is a cross-sectional view taken along line 16—16 of FIG. 12.
Figure 17:
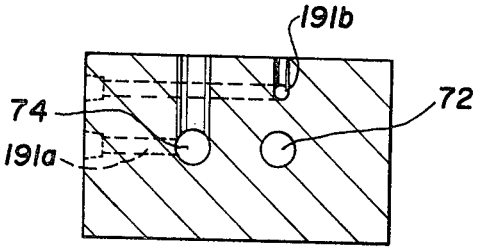
FIG. 17 is a cross-sectional view taken along line 17—17 of FIG. 12.
Figure 18:
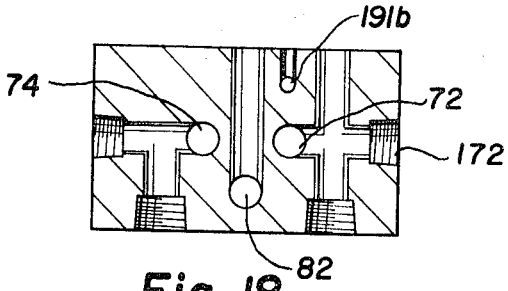
FIG. 18 is a cross-sectional view taken along line 18—18 of FIG. 12.
Figure 19:
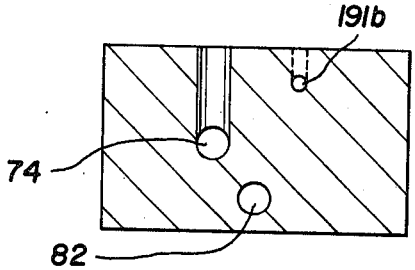
FIG. 19 is a cross-sectional view taken along line 19—19 of FIG. 12.
Figure 20:
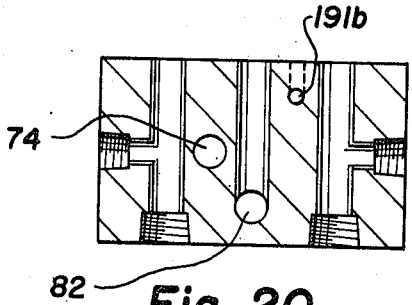
FIG. 20 is a cross-sectional view taken along line 20—20 of FIG. 12.
Figure 21:
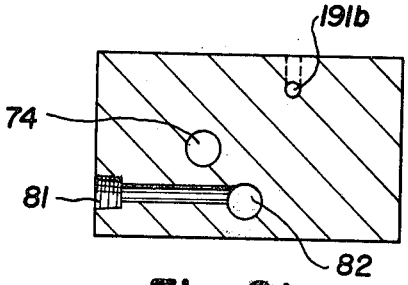
FIG. 21 is a cross-sectional view taken along line 21—21 of FIG. 12.
Figure 22:
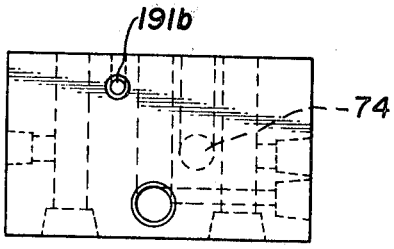
FIG. 22 is a bottom view of the valve block.

Two separate systems are incorporated in the hydraulic schematic diagram illustrated in FIG. 10. A first or primary circuit includes valves 75, 80, **85*a*, 85*b*, 85*c*, and 85*d*. The second or secondary circuit comprises valves 75', 80' and 85'**.

The primary and secondary circuits operate in like manner.

Passage 72 communicates with passages **72*a* and 72*b*, through which pressurized fluid is delivered to valves 75 and 80. Passage 72 also communicates with passages 72*a'* and 72*b'* through which pressurized hydraulic fluid is delivered to valve 75' and valve 80'**.

Valves 75 and 75' are three-position, four-way, manually or electrically or pneumatically or hydraulically actuated control valves, hereinafter referred to as control shifter valves.

Control shifter valves 75 and 75' have first ports communicating with pressure supply passage **72*a* and 72*a'*, respectively. Valves 75 and 75' have second ports communicating with return passage 74, and third ports communicating with regulator passages 76 and 76', respectively. Each of the valves 75 and 75'** has a fourth port which is blocked or plugged.

Regulator passage 76 communicates with gas charged accumulators **77*a* and 77*b* and a pilot actuator 78 of valve 80. Accumulator 77*a* is preferably precharged to a pressure of fifty psi and accumulator 77*b*** to a pressure of 745 psi. The use of a pair of accumulators precharged to different pressures significantly increases the accuracy of the system over a wide range of for example 750–3,000 psi.

Regulator valve 80 is three-position, four-way, spring centered, differential pilot pressure actuated valve.

Regulator valve 80 has a first port communicating with pressure supply passage 72 through passage **72*b*; a second port communicating with return passage 74; a third passage communicating with regulated pressure passage 82**; and a fourth port which is a blocked or plugged.

A second pilot actuator 81 of regulator valve 80 communicates through a pilot passage with regulated pressure passage 82.

Each of the control valves **85*a*, 85*b*, 85*c*, and 85*d* is a three-position, four-way, spring centered, electrically or pneumatically or hydraulically actuated control valve. Each of the control valves has a first port communicating with regulated pressure passage 82 and a second port communicating with return passage 74**.

Control valve **85*a* has a third port communicating with the passage 18*a'* connectable by a line 18*a* to the opening chamber of blowout preventer 18. Control valve 85*a'* has a fourth port communicating with a passage 18*b'* connectable to control line 18*b* communicating with the closing chamber of blowout preventer 18. The third and fourth ports of control valves 85*b* and 85*c* communicate with passages connectable in similar manner with lines communicating with opening and closing chambers of blowout preventers 20 and 22**.

Control valves 85*d* and 85*e* have third and fourth ports communicating with passages 116*a'* and 116*b'* and passages 118*a'* and 118*b'*; respectively, to which control lines can be connected for controlling any other hydraulically actuated valve or other piece of equipment, such as a motor 116 on a choke or a motorized valve 118 on a kill line.

The secondary circuit is identical to the primary circuit, except that only one control valve 85' is illustrated. Parts in the secondary circuit which are the same as those in the primary circuit are designated by like numerals and marked with a prime.

In addition to the source 36 of pressurized fluid, a source 37 of pressurized fluid is provided at a location remote from the drilling rig floor 12.

The source 37 comprises containers of compressed gas, such as nitrogen, having a very low freezing point. If the source 36 fails to provide sufficient pressurized fluid, valve 37*a* can be opened to deliver pressurized gas to supply lines 32*a* and 32*b*.

When it is necessary to operate in extremely cold areas or temporarily at extremely low temperature, the supply lines can be drained of liquid and filled with pressurized gas.

Referring to FIG. 3, it will be appreciated that pressurized fluid from accumulator bottles 65 is delivered through line 31 which is connectable through a suitable connector 130 to supply pressure lines 32*a* and 32*b* as illustrated in FIG. 1 of the drawing. Return line 34 is connectable through a suitable connector to line 33 for returning hydraulic fluid to reservoir 54.

It will be appreciated that hydraulic power unit 36 comprises three separate and independent sources of pressurized fluid. Gas charged accumulator bottles 65, when fully charged, are capable of actuating the blowout preventer stack 14. Air pumps 50 and 50' and electrically driven pump 60 are second and third sources of pressurized hydraulic fluid. Pressurized containers 37 provide a fourth source of pressurized fluid for emergency use.

Referring to FIGS. 1 and 2 of the drawing, the main blowout preventer control panel 30 is mounted on drilling floor 12 of the drilling rig 10. Drilling rig 10 is of conventional design and is illustrated to show the relationship of the main control panel 30 relative to the drilling instrumentation panel 28 which is positioned at the station occupied by the driller who has complete control of the drilling operation.

Figure 4:
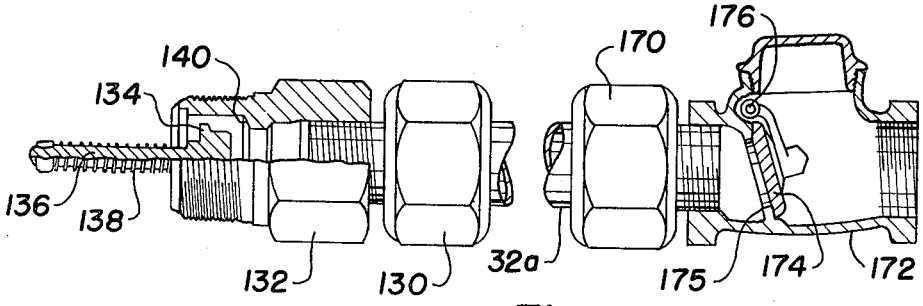
FIG. 4 is a fragmentary cross-sectional view of the pressure supply line and valves associated therewith.

As illustrated in FIGS. 3 and 4, supply line 32*a* has a first end connected to a velocity fuse 132 and a second end connected to a check valve 172.

Velocity fuse 132 is an excess flow check valve adapted to terminate flow therethrough when the flow rate of fluid through the valve exceeds a predetermined rate. A poppet 134 has a stem 136 secured thereto and is urged to the position illustrated in FIG. 4 by a spring 138. Spring 138 engages the body of valve 132 and the stem 136 on poppet 134. When the flow rate of fluid through the valve exceeds a predetermined value, poppet 134 moves into sealing engagement with valve seat 140 to terminate flow through supply line 32*a*.

Check valve 172 is a conventional back flow check valve adapted to permit flow of fluid in one direction only. As viewed in FIG. 4, valve element 174 is moved by fluid flowing from supply line 132*a* away from valve seat 175 thereby permitting flow to the right as viewed in FIG. 4. However, valve element 174 is urged by a spring 176 toward valve seat 175 to prevent flow of fluid to the left as viewed in FIG. 4.

Supply lines 32*a* and 32*b* are of similar construction, each of the supply lines having a velocity fuse 132 connected to a first end thereof to divert flow of fluid to the other line if flow through either of the lines exceeds a predetermined flow rate. Thus, if one of the lines 32*a* or 32*b* becomes ruptured, flow is diverted to the other line. Each of the supply lines 32*a* and 32*b* is connected to a back flow check valve 172 such that the hydraulic control system will be maintained in a pressurized condition even though one of the lines 132*a* or 132*b* may become ruptured.

Conventional connectors 130 are employed for securing first ends of supply lines 132*a* and 132*b* to velocity fuses 132. Conventional connectors 170 are employed for securing second ends of supply lines 32*a* and 32*b* to back flow check valves 172.

Referring to FIGS. 6–22 of the drawing, a valve block 70 is mounted inside the main blowout preventer control panel 30 and the associated hydraulic circuitry illustrated in FIG. 10 is formed in the valve block 70, passages in the valve block 70 communicating with ports in the appropriate valves 75, 80, 85*a*, 85*b*, 85*c* and 85*d*. Control lines 16*a*, 16*b*, 18*a*, 18*b*, 20*a*, 20*a*, and 22*b* extend from ports formed in valve block 70 to the respective blowout preventers 16, 18, 20 and 22.

Referring to FIGS. 10–22, valve block 70 has a passage 72 formed therein to which the end of hydraulic supply pressure lines 32*a* and 32*b* are connectable through a suitable connector 32'. Valve block 70 also has passages 74 formed therein communicating with ports of various valves, as will be hereinafter more fully explained, which are connected through a suitable connector 34' to the end of return line 34.

Two separate systems are incorporated in the hydraulic schematic diagram illustrated in FIG. 10. A first or primary circuit includes valves 75, 80, 85*a*, 85*b*, 85*c*, and 85*d*. The second or secondary circuit comprises valves 75', 80' and 85'.

The primary and secondary circuits operate in like manner.

Passage 72 communicates with passages 72*a* and 72*b*, through which pressurized fluid is delivered to valves 75 and 80. Passage 72 also communicates with passages 72*a'* and 72*b'* through which pressurized hydraulic fluid is delivered to valve 75' and valve 80'.

Valves 75 and 75' are three-position, four-way, manually or electrically or pneumatically or hydraulically actuated control valves, hereinafter referred to as control shifter valves.

Control shifter valves 75 and 75' have first ports communicating with pressure supply passage 72*a* and 72*a'*, respectively. Valves 75 and 75' have second ports communicating with return passage 74, and third ports communicating with regulator passages 76 and 76', respectively. Each of the valves 75 and 75' has a fourth port which is blocked or plugged.

Regulator passage 76 communicates with a gas charged accumulator 77 and a pilot actuator 78 of valve 80.

Regulator valve 80 is three-position, four-way, spring centered, differential pilot pressure actuated valve.

Regulator valve 80 has a first port communicating with pressure supply passage 72 through passage 72*b*; a second port communicating with return passage 74; a third passage communicating with regulated pressure passage 82; and a fourth port which is blocked or plugged.

A second pilot actuator 81 of regulator valve 80 communicates through a pilot passage with regulated pressure passage 82.

Each of the control valves 85*a*, 85*b*, 85*c*, and 85*d* is a three-position, four-way, spring centered, electrically or pneumatically or hydraulically actuated control valve. Each of the control valves has a first port communicating with regulated pressure passage 82 and a second port communicating with return passage 74.

Control valve 85*a* has a third port communicating with the passage 18*a'* connectable by a line 18*a* to the opening chamber of blowout preventer 18. Control valve 85*a* has a fourth port communicating with a passage 18*b'* connectable to control line 18*b* communicating with the closing chamber of blowout preventer 18. The third and fourth ports of control valves 85*b* and 85*c* communicate with passages connectable in similar manner with lines communicating with opening and closing chambers of blowout preventers 20 and 22.

Control valves 85*d* and 85*e* have third and fourth ports communicating with passages 116*a'* and 116*b'* and passages 118*a'* and 118*b'*; respectively, to which control lines can be connected for controlling any other hydraulically actuated valve or other piece of equipment, such as a motor 116 on a choke or a motorized valve 118 on a kill line.

The secondary circuit is identical to the primary circuit, except that only one control valve 85' is illustrated. Parts in the secondary circuit which are the same as those in the primary circuit are designated by like numerals and marked with a prime.

The third and fourth ports of control valve 85' communicate with passages 16*a'* and 16*b'* connectable through control lines 85*a* and 85*b*, respectively, to the opening and closing chambers of annular preventer 16.

Passage 76, accumulator 77 and pilot actuator 78 form a closed system which is charged by actuating control shifter valve 75 to establish a set-point pressure in the closed system, as will be hereinafter more fully explained.

As illustrated in FIG. 10 of the drawing, shifter valves 185', 185*a'*, 185*b'*, 185*c'*, 185*d'* and 185*e'* are three-position, four-way, mechanically or pneumatically or electrically actuated valves for actuating control valves 85', 85*a*, 85*b*, 85*c*, 85*d*, or 85*e*, respectively. The shifter valves are hydraulic pilot valves and are secured directly to the control valves. The pilot valves 185 provide a means for applying for example fifty pounds of force to actuate control valves 85 when a force of for example three pounds is applied by the driller to handle 195 on the front panel of the main control panel 30.

When the control shifter valves 85'–85*e'* are actuated pressurized fluid is delivered to the actuating mechanism of the control valves 85'–85*e'*.

Sequence valve 190 has a bleed port 190' which partially blocks pilot passage 191 until pressure reaches a predetermined pressure, for example 500 psi at cold start-up. Sequence valve 190 partially blocks pilot passage 191 when pressure in the pilot port 191 is less than 500 psi and pressure in pressure supply passage 72 exceeds 500 psi.

In the event supply pressure falls below 500 psi the sequence valve allows the pilot valves to disengage the control valves. The control valves then shift to a block on neutral position thereby trapping fluid at the equivalent of 500 psi in the flow lines between the preventer stack and the valve block. When full pressure is restored, the sequence valve causes fluid to travel to the pilot line and subsequently to the pilot valves which cause the control valves to return to their original positions that they were in before supply pressure was lost.

The sequence valve is installed to allow cold start-up without any special adjustments by the operator. Also in the event supply pressure is lost the pilot system will hold pressure over a period of time until supply pressure is restored. This is aided by a small accumulator that provides additional fluid volume at 500 psi. Then the system will be back in operation without affecting the pilot valve position that was set before pressure was lost.

During the period the supply pressure is cut off or interrupted and falls to zero psi the control valves will center at about 500 psi and trap hydraulic pressure between the control valve and the blowout preventer. This allows a greater margin of safety in that fluid is trapped and the preventer will stay in the position it was in before supply pressure was lost.

Figure 6:
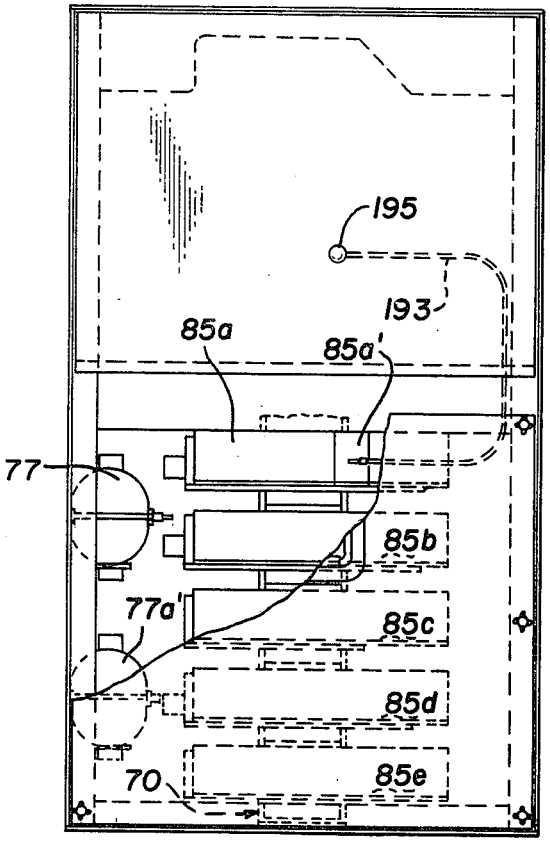
FIG. 6 is an front elevational view of the main blowout preventer control panel, parts being broken away to more clearly illustrate details of construction.
Figure 7:
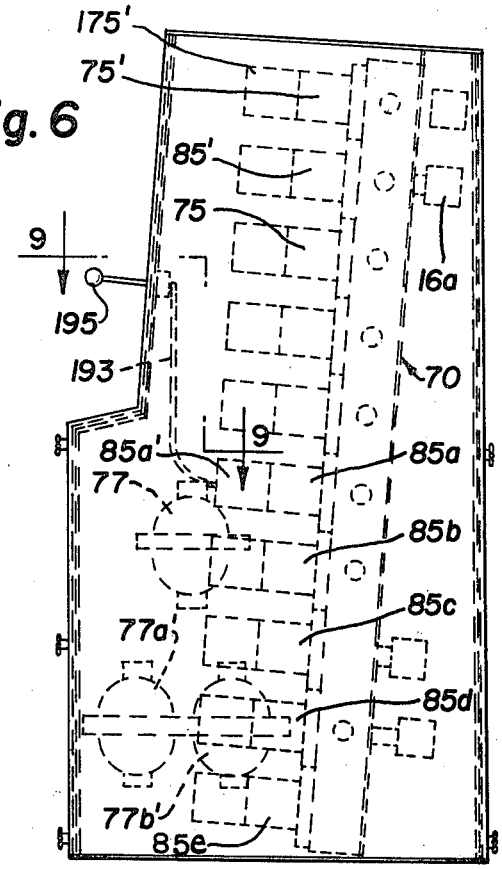
FIG. 7 is an end elevational view of the main blowout preventer control panel.
Figure 8:
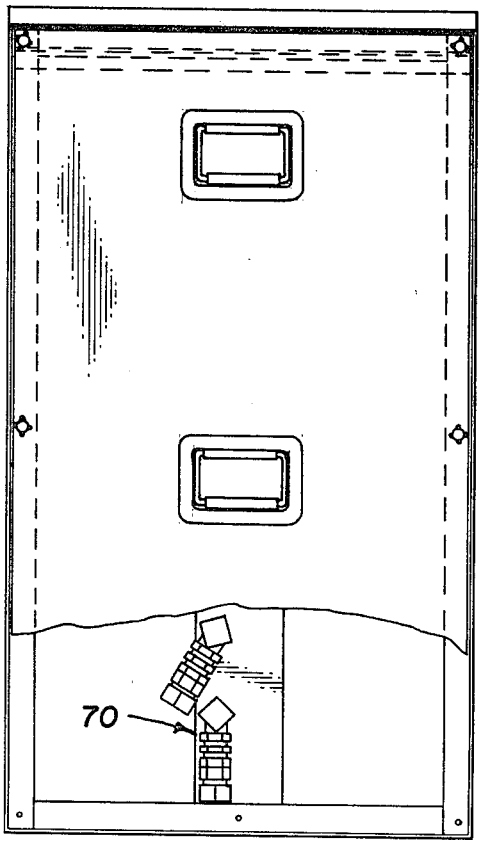
FIG. 8 is a rear elevational view of the main blowout preventer control panel.
Figure 9:
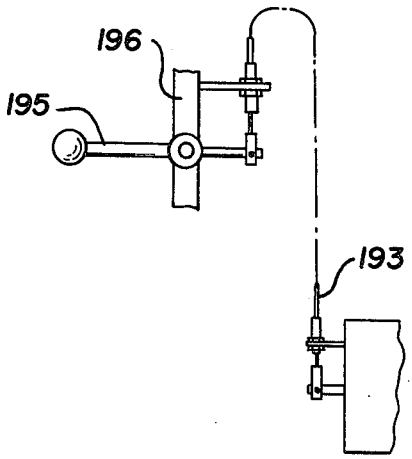
FIG. 9 is a schematic diagram of the manual valve shifting mechanism.

As best illustrated in FIGS. 6, 7, and 9, each of the shifter valves 185 and each of the control shifter valves 75 and 75' has a valve element to which one end of an actuating cable 193 is secured. The other end of the actuating cable 193 is secured to a handle 195 pivotally secured to the front wall 196 of the main blowout preventer control panel 30.

OPERATION

The operation and function of the apparatus hereinbefore described is as follows:

One or more of the pumps 50, 50' and 60 is energized to charge accumulator bottles 65 to a pressure of 3,000 psi. Thus pressure passage 72 in valve block 70 contains pressurized hydraulic fluid at a pressure of 3,000 psi which is available at the first port of each of the shifter control valves 75 and 75' and at the first port of each of the regulator valves 80 and 80'.

When valve 75 is shifted to the left as viewed in FIG. 10 pressurized fluid flows into the closed system through passage 76 thereby charging accumulator 77 to any selected set-point pressure. If this set-point pressure is greater than pressure in regulated pressure passage 82, regulator valve 80 will be shifted to the right as viewed in FIG. 10 and pressurized fluid will be delivered from passage 72*b* to passage 82 until pressure in regulated pressure passage 82 is equal to the set-point pressure in the closed system comprising passage 76, accumulator 77 and pilot actuator 78. When pressure in regulated pressure passage 82 is equal to the set-point pressure, pilot actuator 81 will move valve 80 to the position illustrated in FIG. 10 thereby blocking further flow of pressurized fluid into the regulated pressure passage 82. Manifold pressure gauge 83 indicates the pressure in regulated pressure passage 82.

The secondary system setpoint pressure is established by manipulating control shifter valve 75'. To reduce the setpoint pressure, valve 75' would be shifted to the right as viewed in FIG. 10 allowing hydraulic fluid to flow from passage 76' through valve 75' to fluid return passage 74. As pressure in the closed system comprising passage 76', accumulator 77' and pilot actuator 78' becomes less than the regulated pressure in regulated pressure passage 82', pilot actuator 81' shifts regulator valve 80' to the left as viewed in FIG. 10 permitting fluid from regulated pressure passage 82' to flow through valve 80' to fluid return line 74.

After a set-point pressure has been established by manipulation of control shifter valve 75', the pressure in regulated pressure passage 82' will be maintained equal to the set-point pressure on accumulator 77'.

It should be readily apparent that the set-point pressure on accumulator 77 and the set-point pressure on accumulator 77' are not necessarily the same. For example, in a typical drilling operation, the set-point pressure on accumulator 77' might be 1,500 psi. Control valve 85' might then be shifted downwardly as viewed in FIG. 10 directing pressurized fluid to the open chamber of annular blowout preventer 16.

Accumulator 77 of the primary system might be charged to a pressure of for example, 300 psi for operation of preventers 18 and 20 during a stripping operation wherein drill pipe is being removed from the well. In the event of an emergency, control valve 85' could be manually shifted upwardly as viewed in FIG. 10 thereby applying 1,500 psi pressure to the closing chamber of annular blowout preventer 16.

It should be readily apparent that any desired set-point pressure can be established in either of the accumulators 77 or 77' and that regulator valves 80 and 80' will be automatically shifted by pilot actuators 78 and 81 to maintain the set-point pressure in the respective regulated pressure passages 82 and 82'.

After a regulated pressure has been established in regulated pressure lines 82 and 82', any of the control valves can be manipulated to perform a desired function of opening or closing blowout preventers in a desired sequence and at a selected closing pressure.

Since pressure in regulated pressure passage 82 is maintained at the established set-point pressure, it should be readily apparent that regulator valve 80 will be automatically shifted to maintain the regulated pressure if the regulated pressure for any reason tends to increase or decrease. Thus, if a pipe joint is moved through a closed blowout preventer such that pressure in regulated pressure passage 82 tends to increase, the regulator valve 80 would be shifted to relieve pressure in regulated pressure passage 82 for re-establishing the set-point pressure.

Referring to FIGS. 1, 2, and 3 of the drawing, it will be apparent that the hydraulic power source 36 is located remotely from floor 12 of the drilling rig. However, only two lines, namely supply line 32 and return line 34, are required for connecting the power source 36 to the manually actuatable valves mounted on the valve block 70 in main blowout preventer control panel 30 adjacent the drilling instrumentation panel 28. However, the supply line 32 preferably comprises spaced lines **32*a* and 32*b* to provide alternate paths along which pressurized fluid is delivered to valve block 70. Thus, several thousand feet of piping have been eliminated from systems of the type heretofore employed wherein manually actuatable control valves were mounted adjacent power unit 36**.

Control valves 85', **85*a*, 85*b*, 85*c*, 85*d*, and 85*e*** can be manually actuated by the driller without moving from this primary work station, thus providing a blowout preventer control system which can be actuated quickly when time is of the essence. Further, the position of the manually actuatable control valve eliminates the possibility that the control system might malfunction in the event an electrical or pneumatic valve actuator fails to function at the instant an emergency arises.

Generally, the driller is the first person to become aware of a kick which might result in a blowout; and therefore, positioning the manually actuatable control valve within his reach significantly reduces the likelihood that an uncontrollable blowout might occur. It will be appreciated that when a portion of the drilling mud is blown out of a well, the weight of the column of drilling mud cannot be depended upon for controlling the bottom hole pressure. Therefore, it is necessary that the driller have at his finger tips an immediately responsive control system capable of handling all aspects of pressure control of the well.

A specific arrangement of the hydraulic circuitry in the unitary valve block 70 eliminates the need for the encumberances of conventional blowout control systems and allows all of the control valves to be positioned within reach of the driller.

The mechanical computer/selector 90 is prepositioned by the driller to designate the specific blowout preventer in the stack 14 which should be actuated in the event an emergency arises at any stage of the drilling operation. For example, if the tubing and drill pipe have been removed from the well, selector 90 would be positioned adjacent the manual control handle for actuating control valve **85*c* for delivering pressure to the blind ram preventer 22. However, if drill pipe is in the well, for example during a stripping operation, the indicator might be positioned adjacent the manual actuator of control valve 85*b* for actuating a pipe ram preventer 20**.

It should also be readily apparent that it is not necessary for the driller to leave his drilling station for actuating control shifter valves 75 and 75' for adjusting the set point pressure in accumulator 77 and 77' to any desired pressure.

Figure 5:
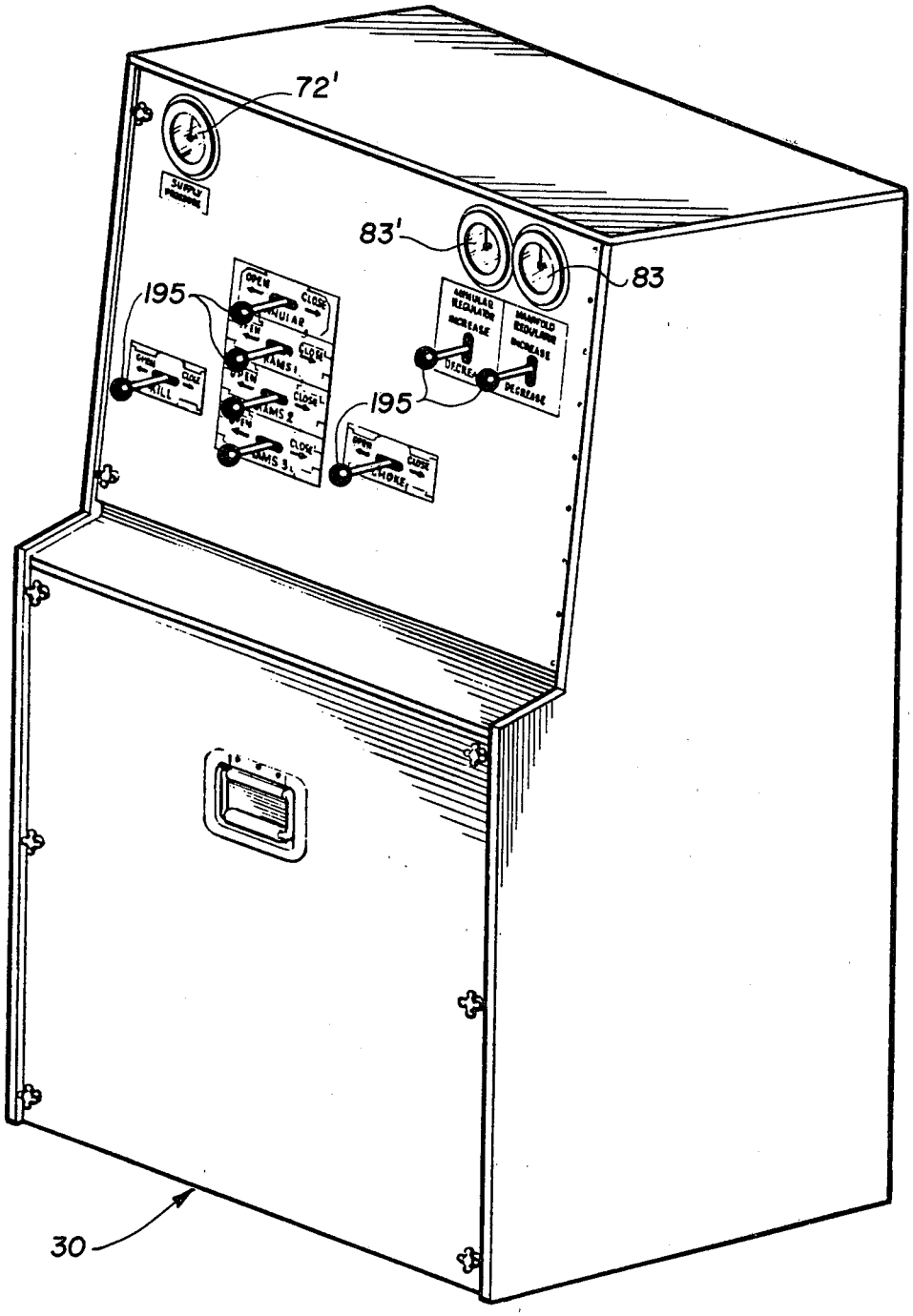
FIG. 5 is a perspective view of the main blowout preventer control panel.

It should further be apparent that the same mechanical motion of the operator is required for actuating control valve **85*a* and for actuating control shifter 75. Thus, the likelihood of confusion when the driller is presented with an emergency will allow the blowout preventers to be closed in substantially less time than has been heretofore required. However, referring to FIG. 5, handles 195 which manipulate control shifter valves 75 and 75'** are preferably moved upwardly to increase pressure and downwardly to reduce pressure.

Since control valves 85', **85*a*, 85*b*, and 85*c* are located at the highest point in the blowout preventer hydraulic control system, any air in any of the control lines will migrate toward the control valves. Thus, control lines extending between valve block 70** and the blowout preventers will be maintained full of liquid at all times. This significantly decreases the time required for closing a preventer relative to the time required by control systems of the type hereinbefore employed wherein preventers were positioned above the elevation of control lines and control valves.

It will be appreciated that a preferred embodiment of our invention has been described, and that other and further embodiments may be devised without departing from the basic concept thereof.

Having described out invention, we claim:

1. A method of regulating pressure of fluid in a regulated pressure line in a blowout preventer control system to which fluid at a higher pressure is supplied from a source of pressurized fluid, the method comprising the steps of: charging a closed system to a set-point pressure at which pressure in the regulated pressure line is to be maintained, said closed system including a pair of accumulators precharged to different pressures, connecting the pair of accumulators through a valve to the source of pressurized fluid, delivering pressurized fluid through the valve into the accumulators to establish the set-point pressure; delivering pressurized fluid to the valve through a first line, diverting flow of fluid from the first line to a second line if the flow rate of fluid in the first line exceeds a predetermined flow rate; sensing the difference between the set-point pressure in the closed system and pressure in the regulated pressure line by applying the set-point pressure of the closed system to a first valve actuator and by applying the regulated pressure of the regulated pressure line to a second valve actuator; and mounting the first and second valve actuators with a regulator valve such that when the pressure in the regulated pressure line is less than the set-point pressure, the regulator valve is actuated to deliver pressurized fluid from the source of pressurized fluid into the regulated pressure line, and such that when the pressure in the regulated pressure line is greater than the set-point pressure, the regulator valve is actuated to remove fluid from the regulated pressure line.

2. A method of regulating hydraulic pressure of an incompressible liquid in a regulated pressure line to which liquid at a higher pressure is supplied from a source of pressurized liquid, the method comprising the steps of: charging a precharged pressure accumulator in a closed system with incompressible liquid to a set-point pressure at which pressure in the regulated pressure line is to be maintained; sensing the difference between the set-point pressure in the closed system and pressure in the regulated pressure line by applying the set-point pressure of the closed system to a first valve actuator and by applying the regulated pressure of the regulated pressure line to a second valve actuator in a three position regulator valve such that when the pressure in the regulated pressure line is less than the set-point pressure, the regulator valve is actuated to deliver pressurized liquid from the source of pressurized liquid into the regulated pressure line, and such that when the pressure in the regulated pressure line is greater than the set-point pressure, the regulator valve is actuated to remove liquid from the regulated pressure line.

* * * * *

UNITED STATES PATENT AND TRADEMARK OFFICE

CERTIFICATE OF CORRECTION

PATENT NO. : 4,413,642

DATED : November 8, 1983

INVENTOR(S) : Gary D. Smith; Richard D. Relyea

It is certified that error appears in the above-identified patent and that said Letters Patent are hereby corrected as shown below:

Column 1, line 8, change "combustile" to -- combustible --
line 50, after "to", first occurrence, insert -- a --;
Column 6, line 64, change "85a'" to -- 85a --
Column 9, line 24, change "118b'" to -- 118b --
line 57, change "85e'" to -- 85e --
Column 11, line 51, after "in" insert -- the --
Column 12, line 61, change "out" to -- our --

Signed and Sealed this

*Third* Day of *April 1984*

[SEAL]

*Attest:*

GERALD J. MOSSINGHOFF

*Attesting Officer*

*Commissioner of Patents and Trademarks*